US010370213B2

(12) United States Patent
Leicht

(10) Patent No.: US 10,370,213 B2
(45) Date of Patent: Aug. 6, 2019

(54) DEVICE FOR WINDING STRIP-SHAPED MATERIAL

(71) Applicant: LEICHT STANZAUTOMATION GMBH, Ölbronn-Dürrn (DE)

(72) Inventor: Jürgen Leicht, Ölbronn (DE)

(73) Assignee: LEICHT STANZAUTOMATION GMBH, Ölbronn-Dürrn (DE)

( * ) Notice: Subject to any disclaimer, the term of this patent is extended or adjusted under 35 U.S.C. 154(b) by 68 days.

(21) Appl. No.: 15/525,247

(22) PCT Filed: Nov. 6, 2015

(86) PCT No.: PCT/EP2015/075880
§ 371 (c)(1),
(2) Date: May 8, 2017

(87) PCT Pub. No.: WO2016/071481
PCT Pub. Date: May 12, 2016

(65) Prior Publication Data
US 2017/0320691 A1 Nov. 9, 2017

(30) Foreign Application Priority Data
Nov. 7, 2014 (DE) ..... 10 2014 222 756

(51) Int. Cl.
*B65H 19/30* (2006.01)
*B21C 47/24* (2006.01)
*B65H 18/02* (2006.01)

(52) U.S. Cl.
CPC ..... *B65H 19/30* (2013.01); *B21C 47/245* (2013.01); *B65H 18/026* (2013.01); *B65H 2701/173* (2013.01)

(58) Field of Classification Search
CPC ..... B65H 19/30; B65H 18/026; B65H 2701/173; B21C 47/245
See application file for complete search history.

(56) References Cited

U.S. PATENT DOCUMENTS 3,690,583 A * 9/1972 Herman ..... B21C 47/24 242/531
2015/0175382 A1* 6/2015 Seifert ..... B65H 54/20 242/397

FOREIGN PATENT DOCUMENTS

DE 3019152 A1 12/1981
DE 202010016384 U1 5/2012
(Continued)

OTHER PUBLICATIONS

International Search Report for corresponding application PCT/EP2015/075880 filed Nov. 6, 2015; dated Feb. 16, 2016.

*Primary Examiner* — Sang K Kim
(74) *Attorney, Agent, or Firm* — Cantor Colburn LLP

(57) ABSTRACT

A device for winding strip-shaped material onto at least one reel (10) comprises a support arm (11) that is movable relative to the machine frame (12) and has at least one horizontal reel shaft (13) for holding the reel (10). The reel shaft (13) holding the reel is made to rotate by at least one rotary drive (14). A release mechanism is provided for releasing the reel (10) when the support arm (11) moves relative to the machine frame (12). In order to design a device that is better adapted to the specificities of rigid materials and to greater weights of the strip-shaped material, the support arm (11) supporting the reel when the strip-shaped material is wound onto the reel simultaneously forms the release mechanism, and a linear movement mechanism (15) is provided for moving the support arm (11) parallel to the reel shaft (13) and transversely to a strip feeding mechanism (16) in order for the reel to be released.

8 Claims, 4 Drawing Sheets

(56) References Cited

FOREIGN PATENT DOCUMENTS

| | | | | |
|---|---|---|---|---|
| DE | 102012106479 | B3 | 6/2013 | |
| DE | 102012016479 | A1 | 2/2014 | |
| DE | 202013105820 | U1 * | 2/2014 | ..... B65H 57/00 |
| DE | 10201300808 | A1 | 7/2014 | |
| JP | 58116929 | | 12/1981 | |
| WO | 2004069706 | A1 | 8/2004 | |

* cited by examiner

DEVICE FOR WINDING STRIP-SHAPED MATERIAL

CROSS REFERENCE TO RELATED APPLICATIONS

The present application relates to and claims the priority of German patent application 10 2014 222 756.9, filed on Nov. 7, 2014, the disclosure of which is here-by expressly incorporated by reference into the subject matter of the present application in its entirety.

TECHNICAL FIELD

The invention relates to a device for winding strip-shaped material onto at least one reel.

BACKGROUND

Strip-shaped material is used in so many ways in industry in order, for example, to produce contact elements in electrical engineering in large quantities as a result of punching. To this end, raw material and, in particular, metal strips are wound onto reels in strip windings. In the majority of cases not just the material processed by the production machine is wound on, it can be attached additionally, for example, to a carrier strip and a separating paper can separate adjacent windings from one another. Equally, the strip material can also be full material, that is to say an unprocessed metal strip. Coming from a production machine such as a punching machine, mostly a loop is provided which, above all when the reel is changed on the winding device, gives sufficient space and time to change from a filled reel to the next empty reel. A lead-in channel, which is moved in dependence on the degree of filling of the reel, is provided for this purpose on the winding device. Both the loop and the movement of the lead-in channel, however, can cause problems as the size of the punched parts increases, as then the strip material also becomes more rigid.

DE 10 2012 016 479 A1 or DE 10 2013 000 808 A1 make known a winding device, in particular for smaller reels, where the material is wound onto cardboard reels which, prior to the filling process, are sucked onto holding elements in order to compensate for the irregularities of the multi-use cardboard reels. Provided for this purpose is a pivotable support arm, which is rotatable about a vertical axis by 180° in order, thereby, to change a reel in the rewinding device, whilst at the same time another reel is released. Two disks, which are located opposite one another, are arranged on the support arm. Additionally provided is an arm which is movable transversely with respect to a feed lance and on which a further disk is arranged. An empty reel is moved onto the shaft of the support arm and is sucked in by means of the disk. Said reel is then rotated by 180° by means of the pivotable arm until it is situated in the region of the feed lance. In said position, the movable arm is moved such that the further disk also abuts against the reel so that the other side wall of the reel can be sucked in by the further disk. The filling procedure is effected in said state. Once the reel is full, the movable arm is moved again in an axial manner transversely with respect to the feed lance and consequently carries out a releasing movement such that the full reel is then pivoted out and the next empty reel can be pivoted in by means of the pivotable arm. The released reel can then be removed manually or by means of a robot for further processing.

Utility model DE 20 2010 016 384 U1 makes known a support arm which is movable parallel to the reel shaft and rotatable and feeds a band removal segment to a coil mandrel.

BRIEF SUMMARY

Proceeding from said prior art, the disclosure provides a device for winding strip-shaped material which is better able to cope with the realities of rigid materials and heavier weights of the strip material.

For releasing the reel, the support arm, which supports the reel during the filling procedure, is movable in a linear manner parallel to the reel axis and transversely with respect to the strip-feeding device for the strip-shaped material. The support arm consequently forms the releasing device for releasing the reel at the same time. The filled reel can consequently be moved laterally out of the feed device, which is provided, in principle, by the outlet of the production machine, such as, for example, a punching machine, and can be transferred there, for example, to a floor conveyor which supplies the reel to its further intended purpose. This is especially important when the reels, for example on account of their weight, are no longer able to be handled manually. The weight of a reel can be as much as a ton such that, also for reasons of health and safety, mechanical devices for conveying the reels are to be used and are preferred over and above the previously known hoists. As a result of the movement of the support arm, the machine is movable per se and can consequently better react to the production conditions. This applies both to the winding and unwinding of the strip-shaped material.

In order to increase said movability further, the support arm is preferably also vertically adjustable. Consequently, it is possible to move the reel instead of the lead-in channel during feeding of the strip-shaped material. The strip-shaped material can consequently be fed from start to finish in the same feed direction or rather at the same feed angle. This is advantageous in particular in the case of rigid materials and additionally provides the advantage of the relationship of separating paper feed to the reel remaining fundamentally almost unchanged such that the separating strip is able to be supplied in a reliable manner. At the same time, a uniform material feed rate is ensured such that the loop, mentioned in the introduction, and consequently also the space necessary for it, can be reduced as far as possible. If the reel changes its position vertically, yet as required, relative to the separating paper feed and to the lead-in channel, the opening angle at which new material can then be introduced is also changed such that easier insertion at the start of the winding operation is made possible.

In principle, the strip-feeding device is provided with a lead-in channel, the inclination of which is adjustable and lockable relative to the reel. As a result, the strips can also be inserted into the reel at an angle without becoming kinked during the feed. For this purpose, the strip-feeding device is mounted, where appropriate, in an articulated manner.

The height of the support arm and/or the inclination of the lead-in channel are preferably altered by means of a control device in dependence on the fill level of the reel. It can be ensured by means of said adjustment that the feed device or rather the feed angle of the strip-shaped material remains the same during the filling of the reel.

Preferably provided are several support arms which transfer the reels into the feed direction in an alternating manner and from there move outward in order to release them. A continuous supply of the strip-shaped material, which is delivered by the production machine, during winding and/or unwinding is ensured as a result.

Further advantages are produced from the subclaims and from the following description of an exemplary embodiment.

BRIEF DESCRIPTION OF THE FIGURES

The invention is explained in more detail below by way of an exemplary embodiment. The Figures are as follows.

DETAILED DESCRIPTION OF PREFERRED EMBODIMENTS

Figure 1:
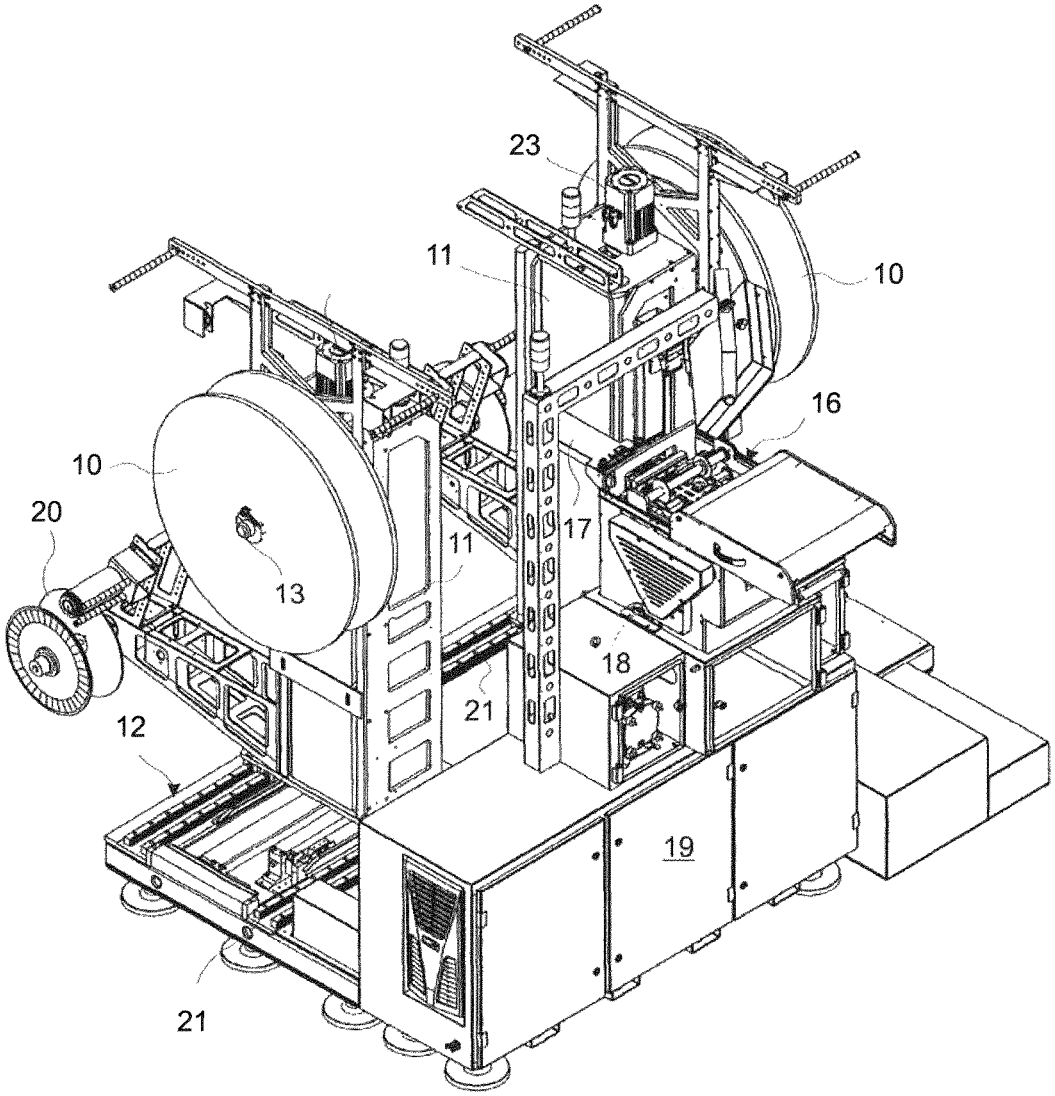
FIG. 1 shows a three-dimensional representation of a device which is provided with two support arms for receiving reels on which strip-shaped material can be wound.
Figure 2:
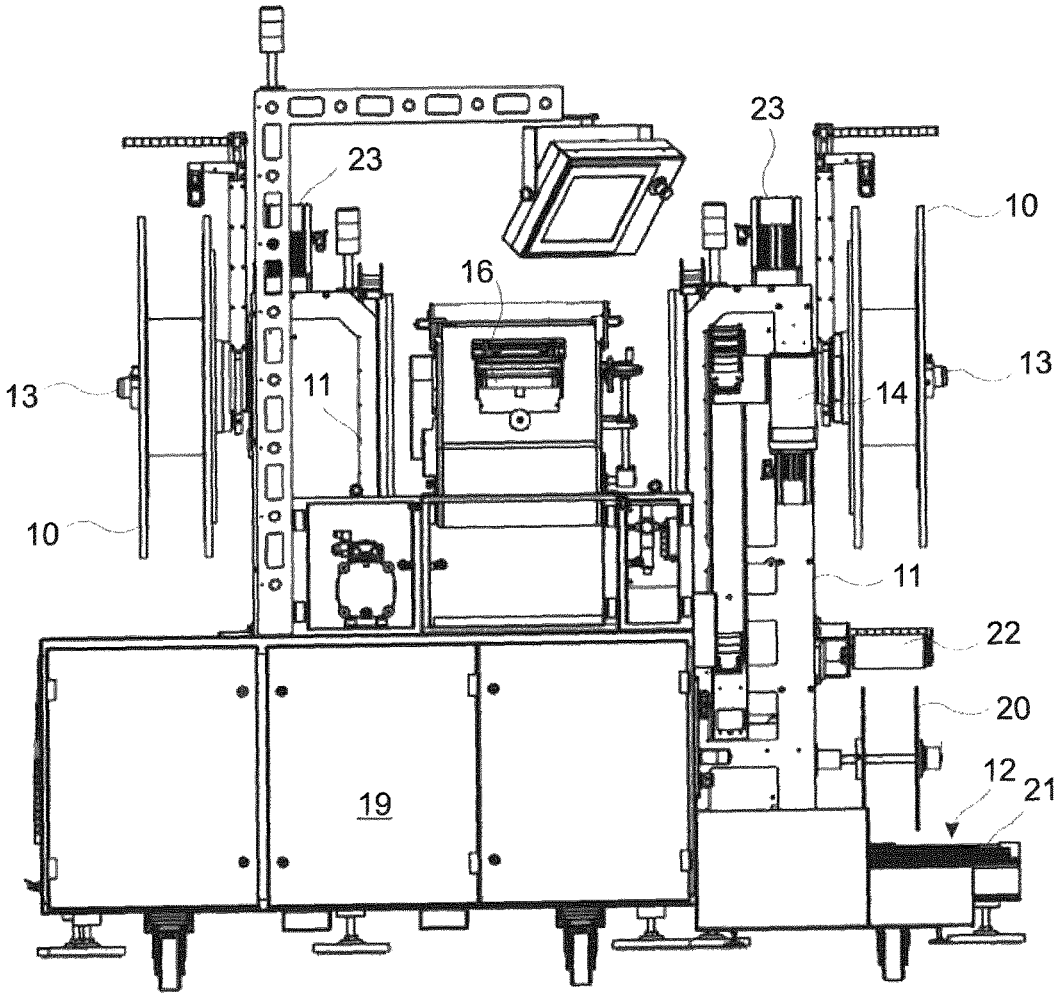
FIG. 2 shows a front view of the device according to FIG. 1.

The invention is now explained in more detail as an example with reference to the accompanying drawings. However, the exemplary embodiments are only examples which are not to restrict the inventive concept to a particular arrangement. Before the invention is described in detail, it must be pointed out that it is not restricted to the respective components of the device or to the respective method steps as said components and methods can vary. The terms used here are simply intended for the purpose of describing particular embodiments and are not used in a restricting manner. When additionally in the description or in the claims the singular or indefinite articles are used, this also relates to the plural of said elements as long as the general context does not clearly indicate something to the contrary.

The Figures show a device for winding strip-shaped material onto at least one reel 10. The winding of the strip-shaped material is to be understood, in this case, as both winding and unwinding the material, i.e. the device can be used for both purposes. Strip-shaped materials are in the majority of cases raw materials, such as, for example, metal strips which have been formed in the production machine which is arranged upstream of the device according to the invention. In this case, these are mostly punching machines which produce, for example, contact elements for electrical engineering.

In a manner not shown, the strip-shaped material comes out of the production machine and is supplied to a receiving region of the device according to the invention in the region of the strip-feeding device 16. From there, the material passes via a lead-in channel 17, which usually extends into the reel 10, to the reel 10 which rotates about the reel shaft 13. A rotary drive 14, which is associated with a support arm in the exemplary embodiment, is provided for this purpose. In order to treat the parts of the strip-shaped material which are wound on top of one another even more carefully, it is possible also to provide a separating paper which is also fed to the reel 10 via the separating paper reel 20 and a separating paper feed 22. The entire device is controlled by a control device 19 which is arranged in a cabinet.

The reel 10 is arranged on a support arm 11 on a machine frame 12, two support arms being provided in the specific exemplary embodiment, which support arms are able to move reels in an alternating manner in the feed direction as a result of a transverse movement. For the implementation according to the invention, however, it suffices if only one support arm 11 is provided, it also being possible, however, for more than two support arms to be used. The feed direction of the strip-shaped material is pre-defined by the transfer region of the production machine and continues on the device according to the invention via the lead-in channel 17. The lead-in channel can engage radially into the reel 10 and can also be realized telescopically. In principle, however, it is also possible to dispense with the lead-in channel 17.

The support arm 11, which supports the reel during the filling procedure, is movable along guide rails 21 transversely with respect to said feed direction or rather with respect to the lead-in channel 17 by means of a linear movement device 15. The support arm 11 comprises a horizontal reel shaft 13 for receiving the reel 10. A lift drive 23 can also be provided on the support arm 11 in order to adjust the height of the support arm.

A releasing device is provided for releasing the reel 10 with the movement of the support arm 11 relative to the machine frame 12. Said releasing device is formed according to the invention by the linear movement device 15 which moves the support arm parallel to the reel shaft 13 and transversely with respect to the strip-feeding device 16 and consequently horizontally. Consequently, the support arm 11 is simultaneously the releasing device. This means that it is also possible for the support arm 11, as the only unit located on the machine frame, to pick up a reel 10 and to convey it to a new point of use or to transfer it to another lifting device, for which the lift drive 23, if required, is advantageous.

Figure 3:
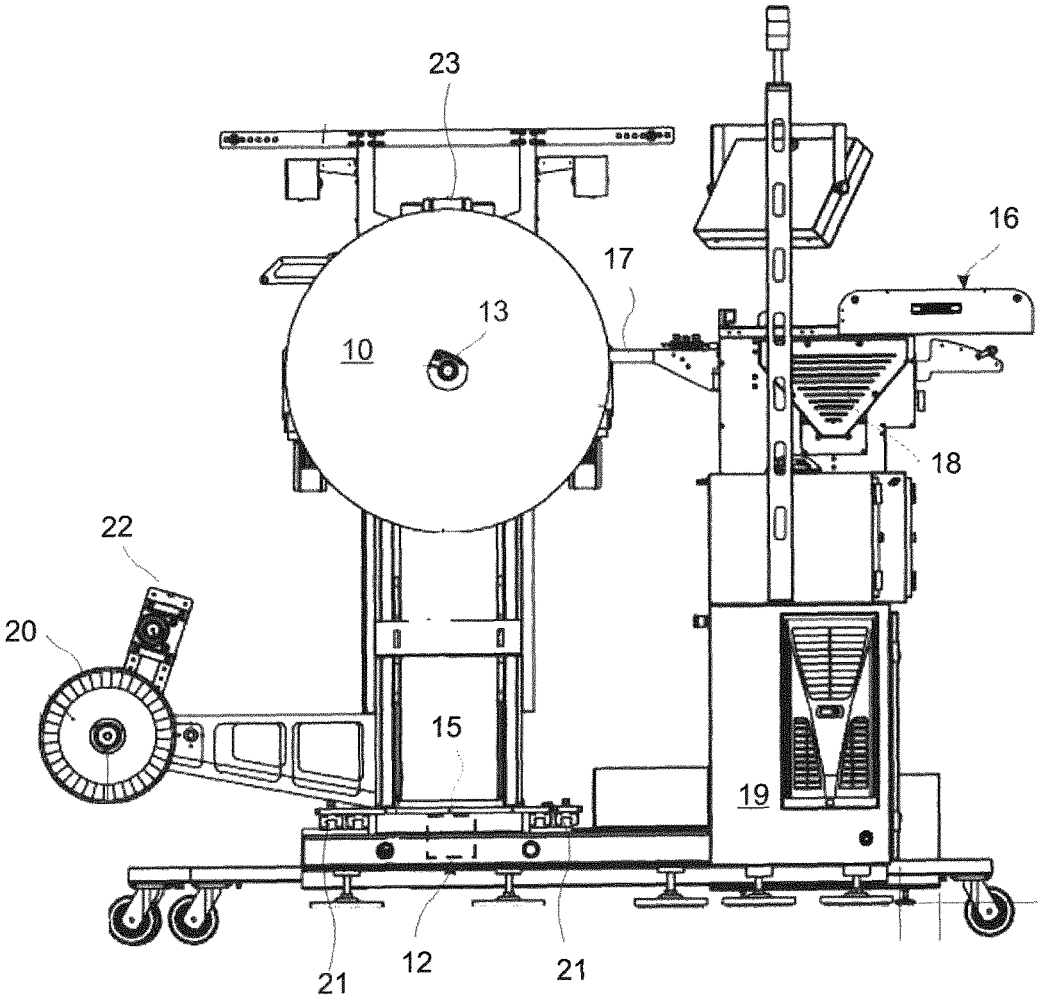
FIG. 3 shows a side view from the left of the device in FIG. 2.
Figure 4:
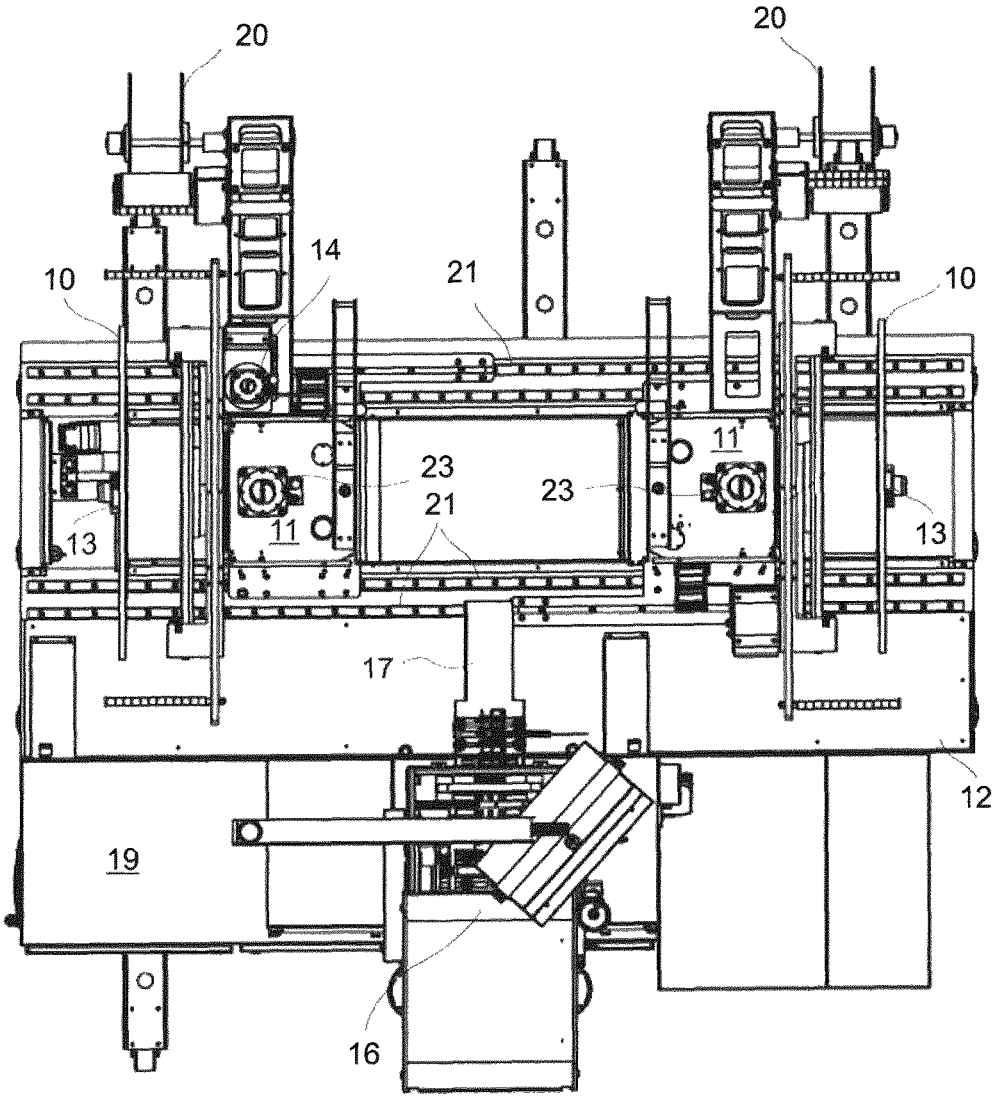
FIG. 4 shows a top plan view of the device according to FIG. 2.

The strip-feeding device 16 can be seen approximately in the middle of FIG. 1 and, according to FIG. 3, said strip-feeding device comprises a lead-in channel 17 which projects into the reel 10. The inclination of said lead-in channel and, where applicable, of the strip-feeding device is adjustable and lockable relative to the reel 10. The strip-feeding device 16 is preferably mounted so as to be pivotable about a joint 18 which can be seen only as an indication in the drawing.

A control device 19, which can alter the height of the support arm 11 and/or the inclination of the lead-in channel 17 if required, is provided in the cabinet. The adjustment of the height of the support arm 11 and of the inclination of the lead-in channel 17 is effected first of all in dependence on the diameter of the reel 10, which is already filled with strip-shaped material, during the filling procedure of the reel, care preferably being taken to ensure that the strips are able to move in at an angle such that they do not kink when being wound onto the reel 10. The more rigid the materials in this respect, the more care must be taken when dealing with said materials, which is possible as a result of such a control device 19. Attempts are preferably made, in this case, to adjust the relationship of strip-feeding device 16 or rather lead-in channel 17 and transfer point of the strip-shaped material to the reel 10 as a result of operating the control device or rather vertical adjustment in such a manner that the feed direction and preferably also feed angle of the strip-shaped material remains the same as far as possible during the filling procedure of the reel 10 from the start to the finish of the filling operation or, during the unwinding operation, also of the emptying operation. This can be ensured as a result of the reel gradually being lowered or raised during the filling procedure by the vertical adjustment being actuated by means of the lift drive 23. The lifting device is realized in such a manner as a vertical adjustment that the height of the support arm 11 is adjustable by means of a spindle drive which is driven by the lift drive 23.

As a result of the vertical adjustability of the reel 10 on the support arm 11, it is also possible to influence the opening angle during the feeding of the material, which is advantageous, above all, at the start of the winding operation. If the reel is moved, for example, downward relative to the separating paper feed and to the lead-in channel, there is an increase in the opening angle at which new material is able to be introduced such that easier insertion is made possible at the start of the winding operation, and in reverse. Consequently, the height of the reel shaft 13 relative to the lead-in channel 17 and/or relative to a separating paper feed coming from the separating paper reel 20 is adjustable.

Said vertical adjustability, however, is also important above all when the reel is released as a result of the transverse movement. In said case, the reel can either be removed from the outside of the device by a floor conveyor or can be transferred to the floor conveyor once the reel shaft has been released. To this end, either the floor conveyor can be vertically adjustable or the reel can be deposited on the floor or on the floor conveyor by means of the support arm. The previously known lifting devices are no longer necessary for this purpose.

If several support arms are provided, as in the exemplary embodiment, they can move the reels alternately in the feed direction of the strip material, which direction is pre-defined by the arrangement of the lead-in channel 17. As a result, a continuous operation is readily ensured.

It goes without saying that said description can be subject to the most varied modifications, changes and adaptations which range within the region of equivalents to the accompanying claims.

The invention claimed is:

1. A device for winding strip-shaped material onto at least one reel comprising a machine frame, at least one support arm which is movable relative to the machine frame and has at least one horizontal reel shaft for receiving the at least one reel and solely supports the at least one reel during a filling procedure, at least one rotary drive for rotating the at least one horizontal reel shaft, a strip-feeding device for feeding the strip-shaped material, wherein the at least one support arm, which supports the reel during the filling procedure, at the same time forms a releasing device for releasing the at least one reel when the at least one support arm moves relative to the machine frame, and is provided as the only releasing device and conveying device for the at least one reel, wherein for releasing the at least one reel, a linear movement device is provided for moving the at least one support arm parallel to the at least one horizontal reel shaft and transversely to the strip-feeding device, wherein a height of the at least one support arm is adjustable by means of a height adjustment arrangement.

2. The device as claimed in claim 1, wherein the strip-feeding device comprises a lead-in channel, the inclination of which is adjustable and lockable relative to the at least one reel.

3. The device as claimed in claim 1, wherein the strip-feeding device is mounted in an articulated manner at the machine frame.

4. The device as claimed in claim 3, wherein the lead-in channel is stationary or fixable in its position.

5. The device as claimed in claim 1, wherein the height of the at least one horizontal reel shaft is adjustable by the height adjustment arrangement relative to at least one of the lead-in channel or a separating paper feed of a separating paper reel.

6. The device as claimed in claim 1, wherein a control device is provided which, when the at least one reel is being filled, varies the height of the at least one support arm in dependence on a diameter of the at least one reel, which is already filled with strip-shaped material, in such a manner that a feed direction of the strip-shaped material remains the same during filling the at least one reel.

7. The device as claimed in claim 1, wherein the at least one support arm as releasing device is solely standing on the machine frame.

8. The device as claimed in claim 1, further comprising two support arms for receiving at least one reel each, the reels thereof being filled in an alternating manner.

* * * * *